US009192535B2

(12) United States Patent
Sverdlik et al.

(10) Patent No.: US 9,192,535 B2
(45) Date of Patent: Nov. 24, 2015

(54) PATIENT LATERAL REPOSITIONING SYSTEM AND METHOD

(71) Applicants: David Sverdlik, Buffalo Grove, IL (US); Alla Sverdlik, Buffalo Grove, IL (US); Bella Dishell, Los Angeles, CA (US)

(72) Inventors: David Sverdlik, Buffalo Grove, IL (US); Alla Sverdlik, Buffalo Grove, IL (US); Bella Dishell, Los Angeles, CA (US)

( * ) Notice: Subject to any disclaimer, the term of this patent is extended or adjusted under 35 U.S.C. 154(b) by 0 days.

(21) Appl. No.: 14/291,170

(22) Filed: May 30, 2014

(65) Prior Publication Data

US 2014/0352058 A1 Dec. 4, 2014

Related U.S. Application Data

(60) Provisional application No. 61/956,058, filed on May 30, 2013.

(51) Int. Cl.
*A61G 7/10* (2006.01)

(52) U.S. Cl.
CPC ..... *A61G 7/1026* (2013.01); *A61G 7/1015* (2013.01); *A61G 7/1044* (2013.01); *A61G 2200/32* (2013.01)

(58) Field of Classification Search
CPC ..... A61G 2200/32; A61G 7/1026; A61G 7/1046; A61G 7/1015; A61G 7/1042
USPC ..... 5/81.1 R, 85.1, 88.1, 84.1, 81.1 HS, 5/81.1 T
See application file for complete search history.

(56) References Cited

U.S. PATENT DOCUMENTS

| | | | | |
|---|---|---|---|---|
| 2,272,778 | A * | 2/1942 | Reuter | 5/85.1 |
| 2,827,642 | A * | 3/1958 | Huff | 5/88.1 |
| 3,490,385 | A * | 1/1970 | Wallace et al. | 104/126 |
| 3,597,774 | A * | 8/1971 | Warren | 5/84.1 |
| 3,829,914 | A * | 8/1974 | Treat | 5/81.1 T |
| 4,296,509 | A * | 10/1981 | Simmons et al. | 5/85.1 |
| 5,280,657 | A * | 1/1994 | Stagg | 5/81.1 R |
| 5,539,941 | A * | 7/1996 | Fuller | 5/85.1 |
| 5,608,929 | A * | 3/1997 | Crane | 5/81.1 R |
| 5,901,388 | A * | 5/1999 | Cowan | 5/81.1 HS |
| 6,282,734 | B1 * | 9/2001 | Holberg | 5/81.1 HS |
| 6,629,323 | B2 * | 10/2003 | Sverdlik et al. | 5/81.1 C |
| 6,662,388 | B2 * | 12/2003 | Friel et al. | 5/86.1 |
| 7,434,278 | B2 * | 10/2008 | White et al. | 5/81.1 R |
| 7,571,498 | B2 * | 8/2009 | Jewell et al. | 5/81.1 HS |
| 7,725,964 | B2 * | 6/2010 | Minning et al. | 5/81.1 R |
| 7,921,484 | B2 * | 4/2011 | Bendele et al. | 5/83.1 |
| 8,156,582 | B2 * | 4/2012 | Rupar et al. | 5/88.1 |
| 8,407,831 | B2 * | 4/2013 | White et al. | 5/87.1 |
| 8,479,360 | B2 * | 7/2013 | Vera | 16/422 |
| 2005/0150045 | A1 * | 7/2005 | Lloyd et al. | 5/81.1 HS |

(Continued)

*Primary Examiner* — David E Sosnowski
*Assistant Examiner* — Eric Kurilla
(74) *Attorney, Agent, or Firm* — Anna Vishev, Esq.

(57) ABSTRACT

A patient lateral repositioning system to move a patient positioned on a patient support of a bed. The system includes a mounting and a pulling system. To enable strength and compactness of the entire system, the mounting is a constructive element removably attached to the support surface to form an integrated structure able to withstand a pulling force to move the patient on any type of a bed positioned apart and independent from the patient lateral repositioning system and the support surface. The pulling system is a set of components including at least one retainer, a guiding element, a drive, a gripper and at least one flexible pulling cable supported by the guiding element and connecting the drive with the gripper.

16 Claims, 8 Drawing Sheets

(56) References Cited

U.S. PATENT DOCUMENTS

| | | | | |
|---|---|---|---|---|
| 2006/0016014 | A1* | 1/2006 | Thaxton | 5/662 |
| 2007/0240260 | A1* | 10/2007 | White et al. | 5/81.1 R |
| 2008/0301873 | A1* | 12/2008 | White et al. | 5/85.1 |
| 2009/0178193 | A1* | 7/2009 | Jewell et al. | 5/81.1 HS |
| 2010/0293711 | A1* | 11/2010 | Minning et al. | 5/81.1 HS |
| 2010/0299841 | A1* | 12/2010 | Lubbers et al. | 5/658 |
| 2013/0025048 | A1* | 1/2013 | Pruett | 5/81.1 HS |
| 2014/0000023 | A1* | 1/2014 | Sverdlik et al. | 5/83.1 |

* cited by examiner

SECTION "A" – "A"

SECTION "B" – "B"

PATIENT LATERAL REPOSITIONING SYSTEM AND METHOD

RELATED APPLICATIONS

This application claims priority to a U.S. Provisional Patent Application Ser. No. 61/956,058 filed on May 30, 2013 and incorporated herewith by reference in its entirety.

BACKGROUND OF THE INVENTION

This application and its disclosure generally relate to the field of patient repositioning mechanisms and methods.

Safe patient handling is one of important aspects of the medical service provided to immobile or limited mobility patients. Where space around the patient's bed is unrestricted, repositioning of a patient from surface to surface is a standard operation. Such repositioning can be performed, for example, by lifting the patient above the transfer surface and then moving him/her to a new position or by performing a lateral transfer, where the patient lying on a sheet is pulled into a new position by a lateral transfer device. Moving a patient in a direction toward a headboard of the patient's bed, however, is a more challenging operation, especially where space and access to the patient's bed are limited.

All currently known lifting devices are heavy and bulky in construction because they have to support a patient's weight in a suspended position. U.S. Pat. No. 6,321,398 B1 ("Wang") and U.S. Pat. No. 4,887,325 ("Tesch") and U.S. Patent Publication No. 2008/0301873 ("White") disclose such known lifting devices.

Lateral transfer devices which are supported by or attached to a transfer surface are disclosed in U.S. Pat. No. 6,629,323. Such devices can be used for transferring patients from surface to surface, when space around the transfer surface (e.g., patient's bed) is not limited, and when these devices do not obstruct patient service. However, in a typical patient environment, such devices can interfere with patient service and become impediments for medical personnel.

Using the known lifting devices for the sole purpose of transferring a patient towards a headboard is also inefficient because of their cost and difficult because the patient has to be lifted before transfer. Further, when it comes to moving a patient toward the bed's headboard, the existing lateral transfer devices have several major limitations. Specifically, (1) existing devices attached to the bed or existing free standing devices are bulky and need space for positioning and operation behind the headboard; in situations, where space is very limited these devices obstruct service and, as a result, limit the ability to use existing transfer devices; (2) special attachment is needed to connect the transfer device to the bed; (3) transfer device must be quickly removed from the bed to have access to the patient from the side of the headboard in medical emergency situations; (4) operation of a lateral transfer device can be obstructed by other medical equipment typically positioned around the headboard of the bed.

In a typical medical facility, the bed's headboard is positioned against the wall, and space on either side of the bed is often taken by medical equipment and furniture. These space limitations impose special requirements on the construction and method of operating of the patient transfer devices. Specifically, such devices should take the minimum of space and should be available for operation with minimal interference with patient care.

There are several known systems partially solving the problem of repositioning the patient toward the headboard of the bed. For example, one known solution is disclosed in U.S. Pat. No. 8,156,582 teaching an electro-mechanical system which is attached to the headboard of the bed and is operated by a remote control. An advantage of attaching the power unit to the bed is the achieved space saving in front and on the side of the bed. However, this system has several significant disadvantages. Specifically, this system is complicated, expensive and must be modified for various types of attachment to different beds depending on the beds' construction. In a typical medical environment, the repositioning device has to be designed for a fast and easy removal from the bed in case of emergency.

Another example of a patient repositioning system is disclosed in U.S. Pat. No. 6,629,323. This system includes manually operated devices attached to the headboard of the bed. While this system is economical, simple, and easy to install and remove from the bed, it also has several disadvantages. Namely, this system requires free space behind the headboard or on a side of the bed for the operator. Where such space is not available, operation of the disclosed devices can be obstructed or limited. Attaching manual or powered transfer devices to the existing mobile and multi-functional beds makes such beds more complicated in operation that is a big disadvantage for a bed with an attached transfer device.

Another patient adjustment, device is disclosed in U.S. Patent Publication No. 2006/0053698 which describes a transfer system secured to the wall adjacent to the bed. Thus, this system solves one of the above-described problems by disengaging the bed from being directly attached to the transfer device. However, the described system is very bulky and includes a complicated and expensive mounting mechanism specifically adapted to fit the disclosed bulky electromechanical transfer system. Further, this system requires a lot of space between the headboard and the wall, and its complexity is clearly illustrated in the patent drawings and description.

SUMMARY OF THE INVENTION

A patient lateral repositioning system, in accordance with the present disclosure, is supported by a support surface positioned independently from a patient transfer surface and able to withhold pulling force to move the patient. The system includes a pulling system and a mounting. The mounting is secured to a support surface and is adapted to allow multi-positioning of various components of the pulling system in order to move the patient in needed direction. The pulling system includes a drive which is adjustably positioned away from the bed so as not to interfere with patient service and in order to perform comfortable manual operation In one general aspect, the a pulling system includes a retaining element, a drive movably mounted on one of the retaining element and the mounting, a gripper removably attached to the patient support, at least one pulling cable flexibly connecting the drive to the gripper, and at least one guiding element supporting the pulling cable. The guiding element is positioned on and is movable with respect to the retaining element and is selectively positionable at plural locations along the retaining element. The guiding element is configured to support and guide the pulling cable in a desired direction. Finally, the retaining element of the pulling system is movable and positionable at multiple locations along the mounting.

In another general aspect, the present invention is a method of moving a patient toward a head board of a bed by a patient transfer system supported by a support surface positioned apart from a patient transfer surface said method comprising the steps of positioning a retaining element with at least one guiding element. The method further includes the step of cooperably connecting a pulling system with at least one pulling cable, flexibly connecting a drive with a gripper and a mounting member attached to the support surface and adapted to hold the retaining element and the pulling system. The method further includes the step of positioning at least one guiding element located at multiple positions along the retaining element to support and guide the at least one pulling cable in desired direction whereby the retaining element is adapted to be attached to the support surface and is adjustable positioned on the mounting member.

The system of the present invention provides new patient transfer system for lateral patient repositioning towards the head board of the bed, where the system attached to the support surface may withhold pulling force to move the patient and position apart from the transfer surface. The design of the present invention solves disadvantages of the prior art and offers a completely new design that is safe, compact, simple in construction and operation.

The above aspects, advantages and features are of representative embodiments only. It should be understood that they are not to be considered limitations on the invention as defined by the claims. Additional features and advantages of the invention will become apparent in the following description, from the drawings, and from the claims.

BRIEF DESCRIPTION OF THE DRAWINGS

The invention is illustrated by way of examples which are not a limitation, and the figures of the accompanying drawings in which references denote corresponding parts, and in which.

DETAILED DESCRIPTION OF THE INVENTION

As illustrated in the attached FIGS. 1-13, different constructions and layouts of a patient transfer system (the system) are shown in accordance with different embodiments of the invention. Differences in the layout stem primarily from the type of the supporting surface, i.e., vertical or horizontal support surfaces. FIGS. 1-4A illustrate the system mounted on a vertical support surface "A". As used throughout this specification, the term "support surface A" refers to a vertical support surface, and the term "support surface B" refers to a horizontal support surface.

Figure 1:
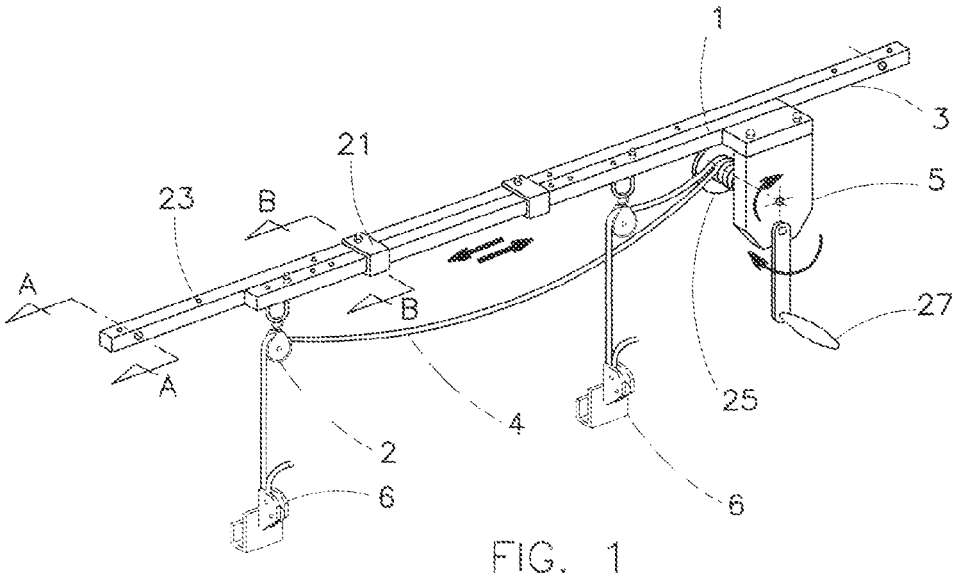
FIG. 1 is a schematic diagram of the patient transfer system in accordance with the preferred embodiment of the present invention.
Figure 2:
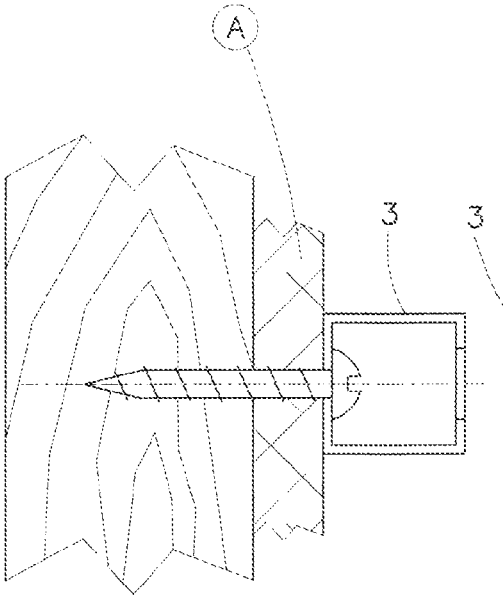
FIG. 2 is a cross-sectional view of the patient transfer system of FIG. 1 taken along the line A-A.
Figure 3:
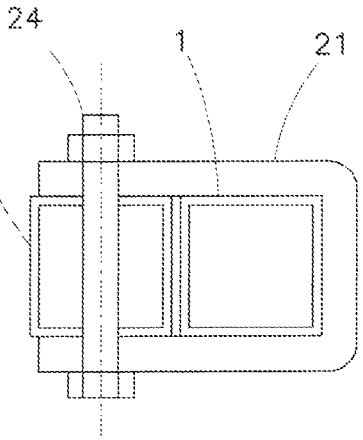
FIG. 3 is a cross-sectional view of the patient transfer system of FIG. 1 taken along the line B-B.

As shown in FIG. 1, the system preferably includes a mounting 3 and a pulling system which includes at least one pulling cable 4, flexibly connecting a drive 5 with a gripper 6; at least one guiding element 2 supporting at least one pulling cable 4; and a retainer 1, adapted for multi-positioning of the guiding elements 2 and the drive 5. The components of the pulling system are assembled on the retainer 1, and the mounting 3 is removably attached to the vertical support surface A, thus allowing for multi-positioning of the retainer 1. In accordance with the preferred embodiment, mounting 3 is connected to the support surface, as more particularly shown in cross section A-A (FIG. 2), and is configured to support the retaining element 1. The retaining element 1 is attachable to the mounting 3 as shown in cross-section B-B (FIG. 3).

Figure 4:
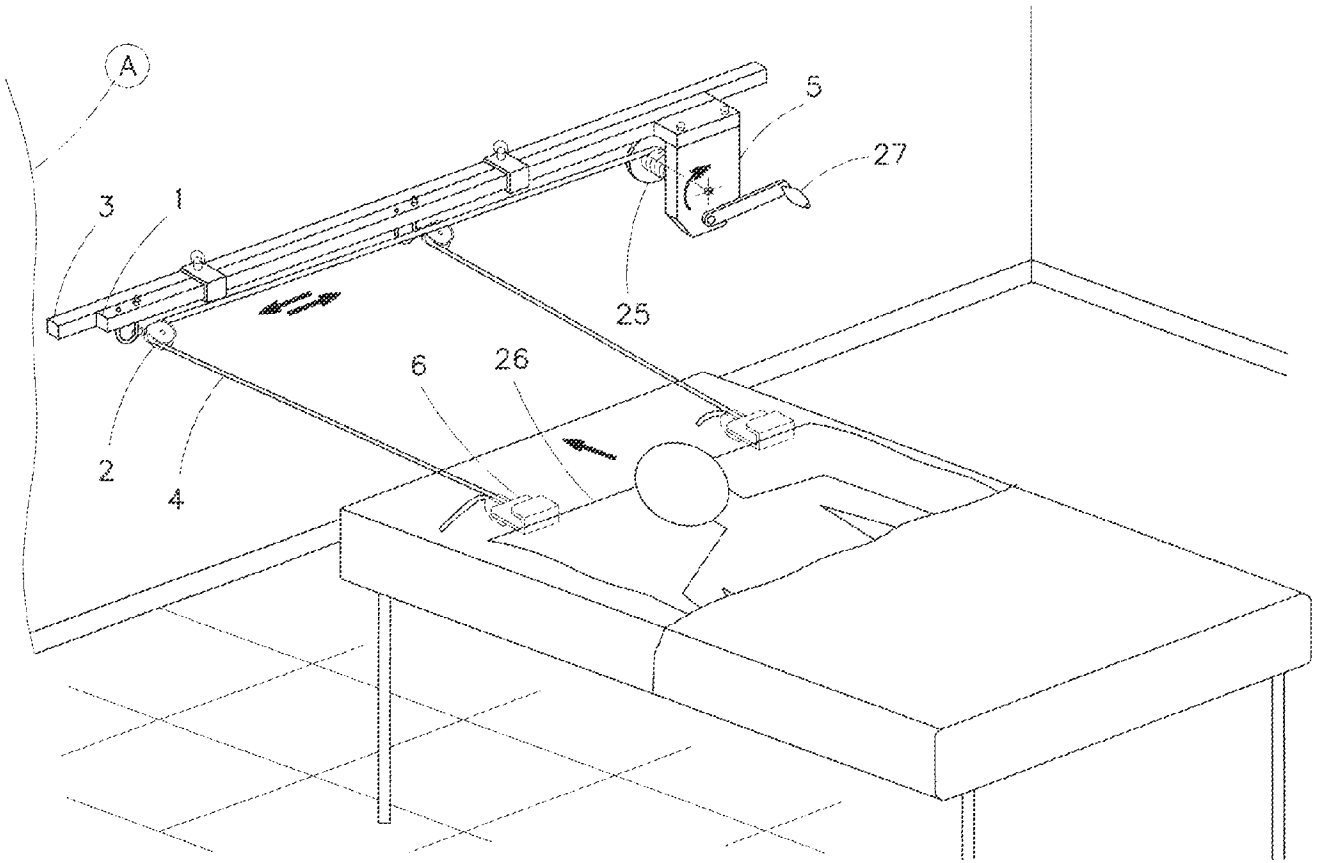
FIG. 4 is a schematic diagram illustrating operation of the patient transfer system mounted on a vertical surface with a single bar.

It should be understood by a person skilled in the art, that the retaining element 1 can be secured to the vertical support surface A directly, i.e., without the mounting 3. Drive 5 is a source of pulling power and can be connected to the retaining element 1 or to the mounting 3. The gripper 6 is operatively engaged with the cable 4 and can be selectively and removably attached to the patient support 26 (as shown in FIG. 4). The retaining element 1 has multi position mountings for one or more guiding elements 2 and for the drive 5. The connection defined between the gripper 6 and the drive 5 is flexible[1], i.e., allowing the user to adjust positioning of the entire system and its separate elements, as explained in more detail below.

[1] As used in the present Application, the term "flexible" means a connection which can be easily adjusted in accordance with a particular user's need.

Referring back to FIGS. 1-3, the system is attached to the vertical support surface A. The mounting 3 is preferably a tubing with two sets of inlets 23 formed therein perpendicularly to its axis. One set of inlets is used for removably and adjustably attaching the mounting 3 to the vertical support surface A, and the other set of inlets is used for removably and adjustably connecting the retaining element 1 via brackets 21 to the mounting 3. As illustrated in FIG. 3, brackets 21 are preferably positioned on the mounting 3 in a position corresponding to a desired inlet 23 and secured to the mounting 3 by placing a screw 24 through the inlet 23. Retaining element 1 is positioned within brackets 21 such that, when screws 24 are loosened, the retaining element 1 is movable along the mounting 3 so as to adjust the position of the retaining element 1 on the mounting. By tightening screws 24, the retaining element 1 is securely affixed to the mounting 3. Thus, the disclosed design allows for multi-positioning of the retaining element 1 along the mounting 3.

Alluding to the above, each cable 4 is supported by the guiding element 2. The gripper 6 is remotely and operatively attached to one end of the cable 4, where the other end is connected to the output shaft 25 of the manual drive 5. In the embodiment illustrated in FIG. 1, manual drive 5 is preferably positioned at the end of the retaining element 1 to allow for a greater linear space for adjusting position of the guiding elements 2 along the retaining element 1.

Manual drive 5 can be a gear box, in which the output shaft 25 is operatively connected to the revolving crank (i.e., the handle) 27. Cables 4 attached to the output shaft 25 wind onto the output shaft when the revolving crank 27 is activated. The revolving crank 27 can have a telescopic construction to adjust the applied force to different weights of patients, as illustrated on FIG. 12. The flexible connection defined between the gripper and the drive allows the drive to be positioned in different positions along the retaining element 1. Further, for the convenience of the operator, drive 5 can also be positioned at different angles on the mounting 3 or retaining element 1 with respect to the vertical support for more comfortable handle operation, as illustrated on FIGS. 10 and 11.

Figure 4A:
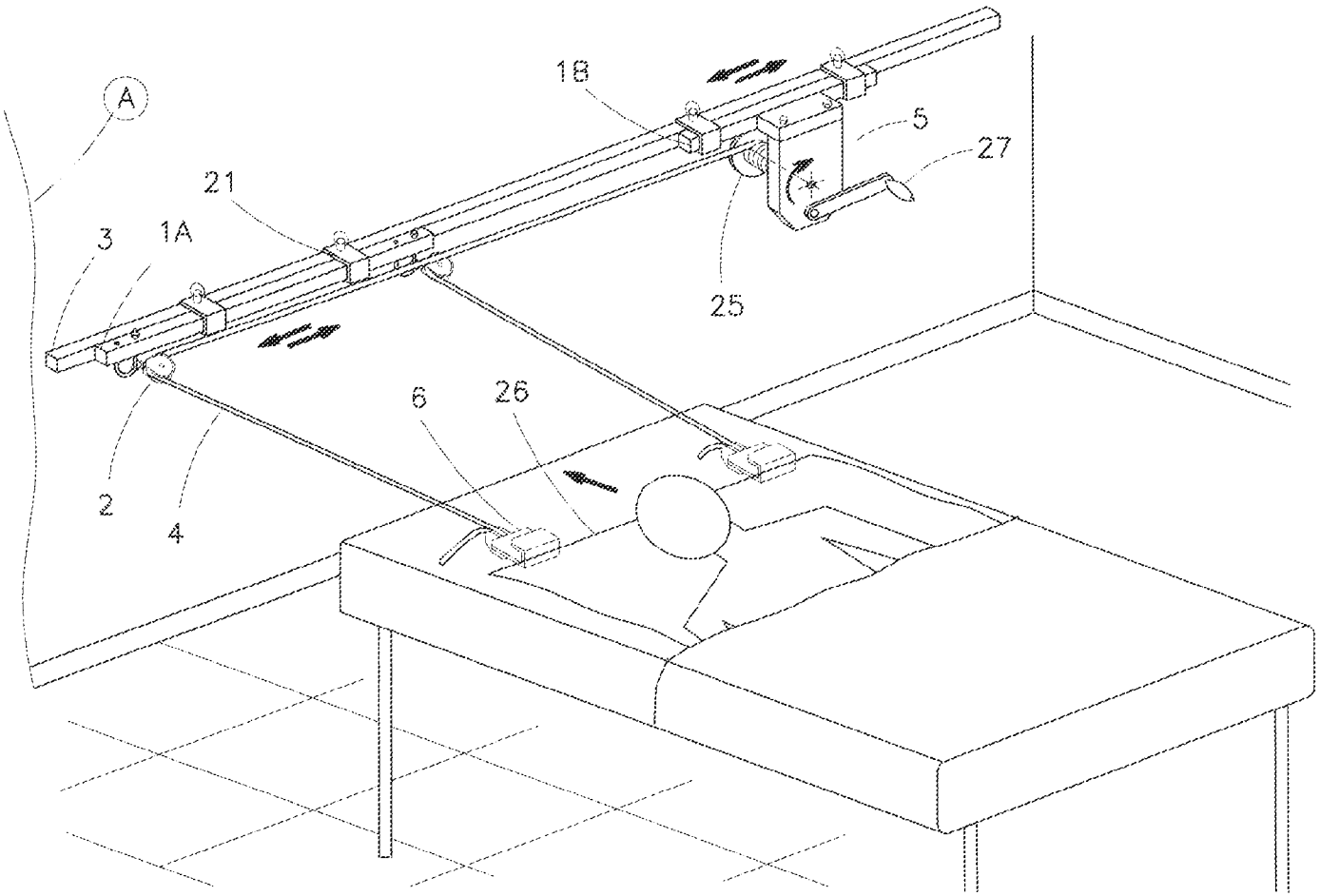
FIG. 4A is a schematic diagram illustrating operation of the patient transfer system mounted on a vertical surface with two discrete retaining bars.

FIGS. 4 and 4A demonstrate the use of the pulling system attached to the vertical support surface A and engagement of the grippers 6 with the patient support 26. As the revolving crank 27 is rotated, drive 5 winds cable 4 onto the output shaft 25 pulling the grippers 6, which, in turn, pull the patient support 26 with the patient located thereon in the desired direction (i.e., towards an imaginary headboard). The mounting 3 is preferably positioned at a height which is ergonomically comfortable for manual operation. This design is preferable for the beds having vertical movement. In this layout, the system does not take up any space between the head of the bed and the wall, and the drive 5 can be positioned at a height and/or a position along the retaining element 1 that is desirable for ergonomically comfortable operation of the revolving crank 27.

In use, the operator of the system described in FIG. 4, will first position the bed into a close proximity of the pulling system. The retaining element 1 with drive 5 mounted thereon is then moved into a desired position along the mounting 3. Such desired position is typically distanced from the bed to avoid interference with patient's care. Once the desired position is selected, the drive is secured at the selected position. Next, guiding elements 2 are positioned on the retaining element 1 so as to move the patient in the needed direction. Grippers 6 are then connected to the patient support (sheet) 26 and moved using the cable 4 so as to create tension in the entire connection from the patient support 26 to the drive 5. The patient can then be moved in the desired direction by operation of the manual drive 5. It should be understood, that the disclosed system allows for the mounting 3 and the retaining elements to be positioned at various heights comfortable for manual operation.

FIG. 4A illustrates a modification of the pulling system, where the components of the pulling system are assembled on two separate retaining elements 1A and 1B, where the retaining element 1A is adapted for positioning guiding elements 2 and the retaining element 1B is adapted for connecting manual drive 5. Retaining element 1A is preferably positioned approximately centered with respect to the patient's bed, the guiding elements 2 being positioned on the retaining element 1A to move the patient in needed direction. Retaining element 1B, with the drive 5, is movable along the mounting 3 so as to be positioned in a position desired for the operation, typically at a distance from the bed where it would not interfere with patient's care, while still being within a comfortable reach of the operator. Once such position for the drive is selected, the drive is secured in such position. This modified pulling system, as described on FIG. 4A, has a much bigger range of adjusting distance between guiding elements 2 and the drive 5. As can be seen from this Figure, this range of adjustment will only depend on the length of the mounting 3.

In use, the operator of the system described in FIG. 4A, first positions the bed into a close proximity to the pulling system. The retaining element 1A is then approximately centered (or otherwise aligned) with respect to the bed, and guiding elements 2 are positioned thereon in positions corresponding to the desired direction of patient's movement. The retaining element 1B with the drive 5 mounted thereon, is then moved into a desired position along the mounting 3. Such desired position is typically distanced from the bed to avoid interference with patient's care and other equipment. Once the desired position is selected, the retaining element 1B is secured at the selected position. Grippers 6 are then connected to the patient support (sheet) 26 and moved using the cable 4 so as to create tension in the entire connection from the patient support 26 to the drive 5. The patient can then be moved in the desired direction by operation of the manual drive 5.

Layout of the system as shown in FIGS. 1-4A, has multiple benefits in the process of moving the patient towards the headboard of the bed: (1) no space is needed between the vertical support surface A and the bed, and (2) the flexible gripper-drive connection and the ability of the retainer 3 (or retainers) to be multi-positionable along the mounting 3, allows for the drive 5 to be placed at a position and/or at a height which can be easily adjusted for ergonomically comfortable operation of the revolving crank 27.

Figure 5:
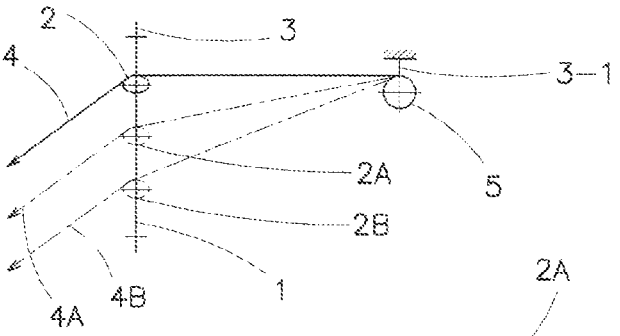
FIG. 5 is a schematic diagram of a layout of the patient transfer system mounted on a vertical support surface.

FIGS. 5-9 illustrate different layouts of the patient repositioning system, where such system is mourned on the vertical support surface A. These system variations are adapted for work with hospital beds with and without a vertical movement. FIG. 5 illustrates a system layout, where the retaining element 1 is in a vertical position and is attached to the mountings 3. The manual drive 5 is located in one of the desired positions for comfortable operation and is attached to the base 3-1, separate and distinct from the base 3. Guiding element 2 can be positioned at various height positions, e.g. 2*a*, 2*b* or others, so as to support the pulling cable 4 at different heights and, accordingly, pull the patient at different angles towards the head of the board. 4*a* and 4*b* is different positioning of the cable 4. This design is preferable, when a single puling cable 4 is used, and the bed does not have a vertical movement.

Figure 6:
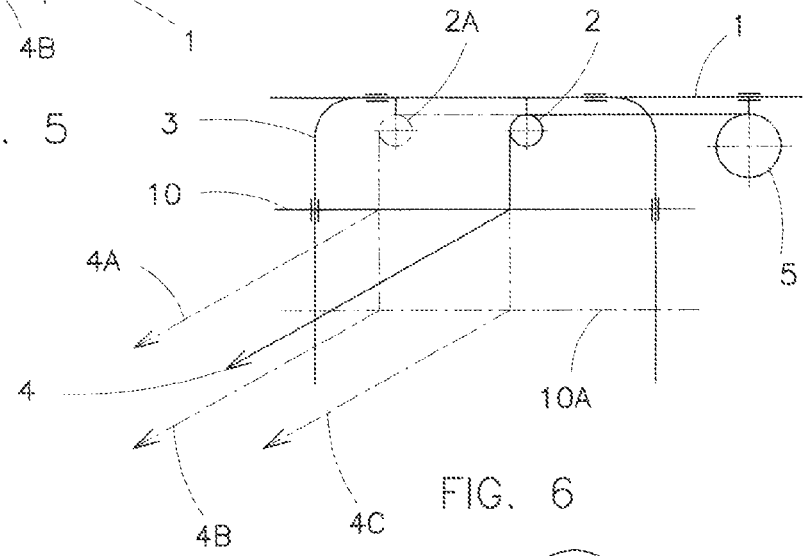
FIG. 6 is a schematic diagram of an alternative layout of the patient transfer system mounted on a vertical support surface.

FIG. 6 describes a layout, which can be used for beds with and/or without vertical movement. In this embodiment, mounting 3 is a U-shaped tubular bracket with a set of holes for attaching retaining element 1 and guiding shaft 10. Multiple holes on the U-shaped bracket, allow the user to adjust the vertical position of the retaining element 1 and the guiding shaft 10 to various desirable heights. In manual operation of the system, retaining element 1 can be set at various desired heights for economically comfortable manual operation of the drive 5. Positioning guiding elements 2 along the retaining element 1 further allows the user to adjust a horizontal position of the pulling cable(s). By placing cables 4 behind the guiding shaft (as shown, for example, in FIG. 8 with respect to another embodiment) and changing the vertical position of the guiding shaft 10, the user is also able to more precisely direct the pulling cable for the desired gripper-patient support engagement. Positions 4A, 4B and 4C in FIG. 6 are a few of the many adjustments which can be made.

Operation with two cables is similar. This layout of the system gives a lot of flexibility in patient transfer for any types of beds.

Figure 7:
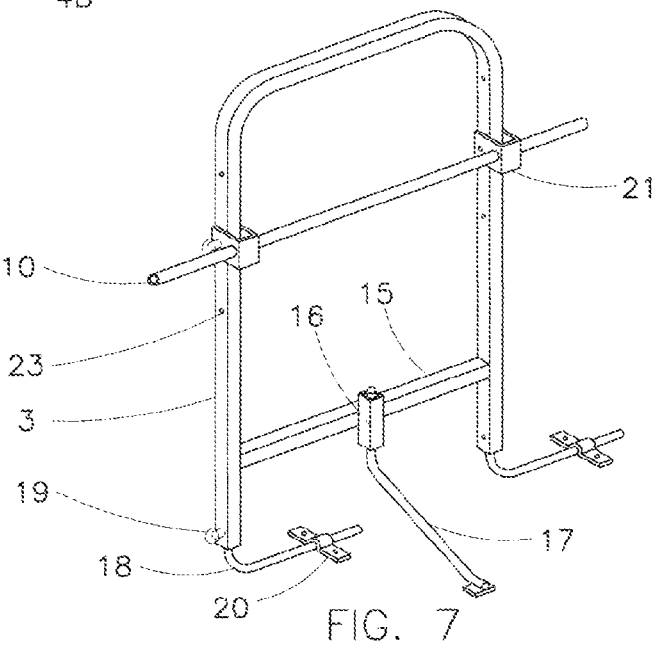
FIG. 7 is a schematic diagram of a mounting system for the patient transfer system mounted on a horizontal support surface.
Figure 8:
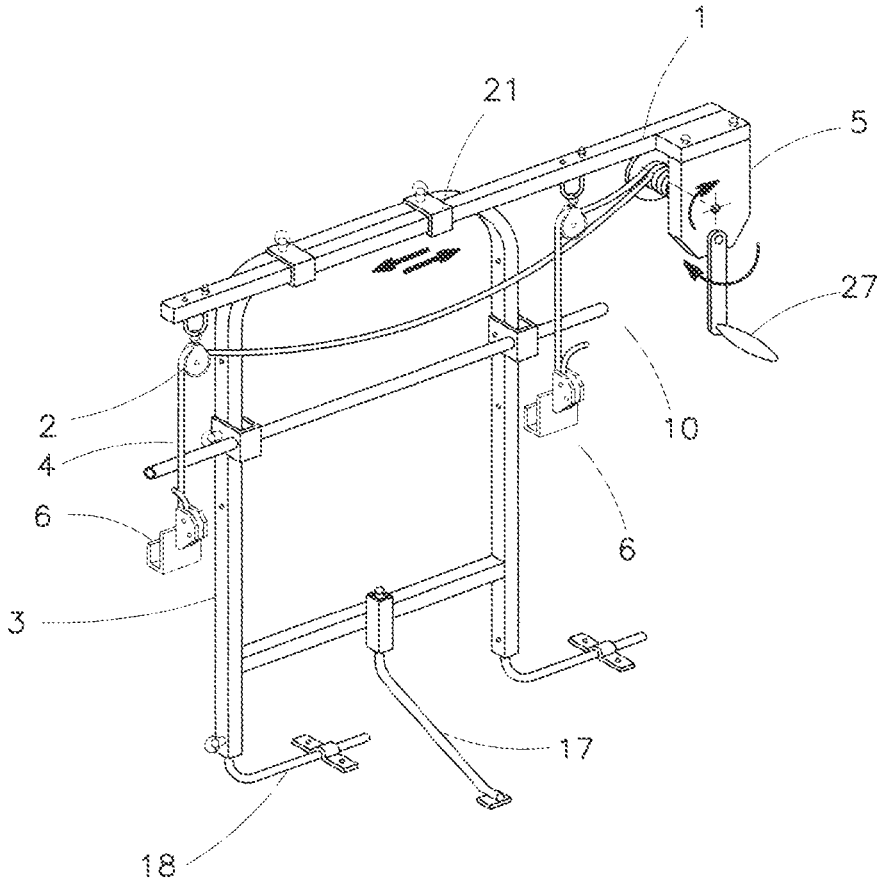
FIG. 8 is a schematic diagram of the patient transfer system mounted on the mounting system of FIG. 7.

In accordance with another embodiment of the present invention, FIGS. 7 and 8 describe the patient repositioning system mounted on a horizontal support surface B.

FIG. 7 illustrates the mounting system for the patient repositioning system, where the mounting system includes a U-shaped tubular mounting 3 with a cross bar 15 fixedly secured between the two vertical legs of the mounting. Cross bar 15 is preferably welded at 10-15 inches above the ends of vertical legs. Housing 16 is positioned on and secured to the cross bar 15.

Angular bracket 17 is pivotally connected to the housing 16 with one end, with the other end resting on the horizontal support surface B. Angular bracket 17 is preferably positioned at a 90° angle to the U-shaped mounting 3, so as to support the attached to the floor mounting bracket from tilting under a pulling force. An L-shaped bracket 18 is inserted into each of the vertical tubular legs of the mounting and is removably connected to the respective tubular leg with a spring loaded pin 19. Each L-shaped bracket 18 is removably attached to the horizontal support surface B with brackets 20. Position of the U-shaped mounting 3 can be adjusted on the supporting surface B using the L-shaped brackets 18. Multiple holes on the mounting allow the user to adjust the vertical position of the retaining element 1 and the guiding shaft 10.

FIG. 8 illustrates operation of the patient repositioning system, where the horizontal support surface B is a floor. As described in more detail with respect to FIG. 7, the system includes the U-shaped mounting 3 secured to the floor with L-shaped brackets 18 and supported in a vertical position by the angular bracket 17. Retaining element 1 and guiding shaft 10 are attached to the U-shaped mounting 3 with connecting brackets 21. The system further includes guiding pulleys 2 supported by the retaining element 1, drive 5, grippers 6 and pulling cables 4 supported by pulleys 2 and connected to the drive 5, at one end, and grippers 6, at the other end. Each gripper 6 is selectively and removably attached to a patient support (e.g., a bedding sheet on which the patient is positioned) allowing for the patient to be pulled in the desired direction when the drive is activated by rotating handle 27. By disconnecting the retaining element 1 from the U-shaped mounting 3 or by disconnecting the L-shaped brackets 18 from the supporting surface B, the patient repositioning system can be partially or completely removed from the supporting surface B, thus allowing for the ease of assembly/disassembly.

Figure 8B:
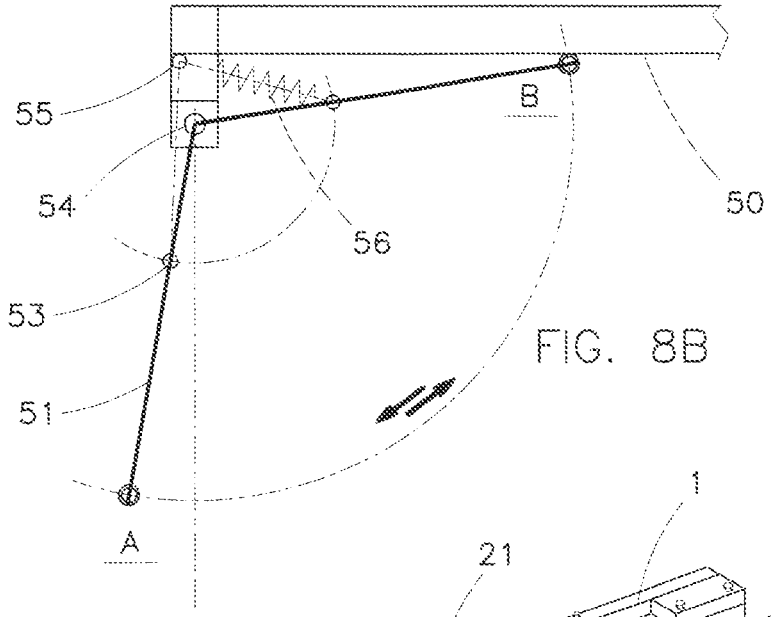
FIG. 8B is a schematic diagram illustrating a compression spring mechanism utilized with the patient transfer system mounted and the mounting system of FIG. 8A.
Figure 8A:
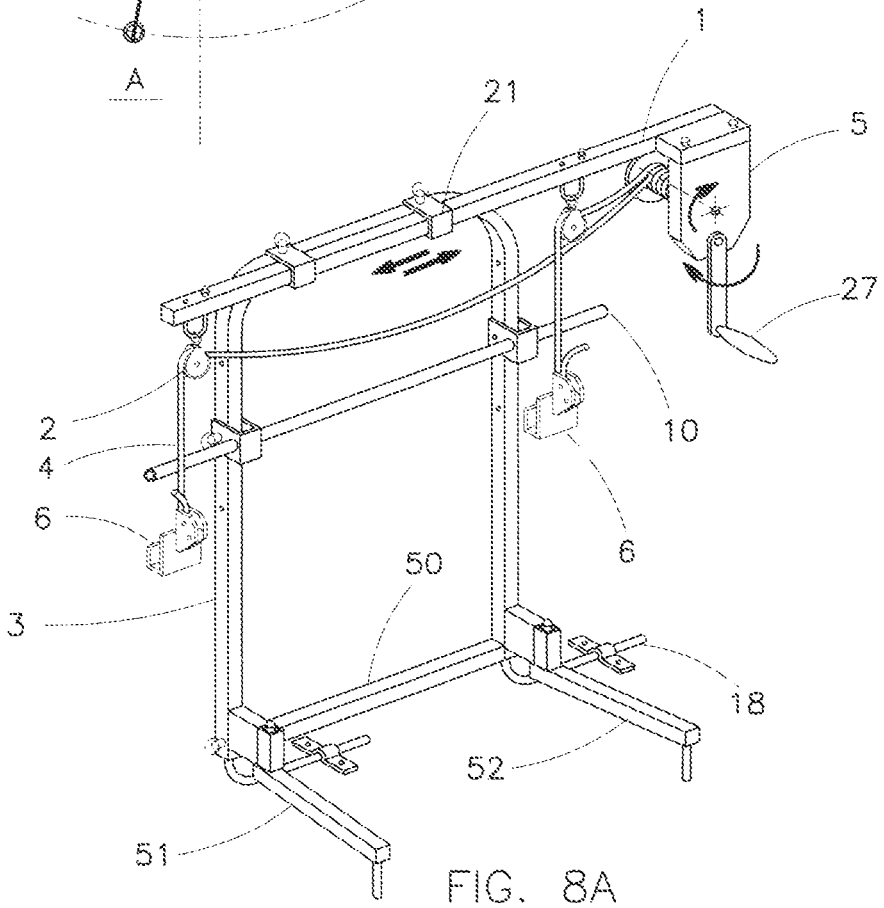
FIG. 8A is a schematic diagram of the patient transfer system mounted on a modified mounting system.

FIG. 8A illustrates an alternative embodiment, in which the mounting 3 is supported in its vertical position by two pivotal support legs 51 and 52. In this embodiment, the mounting 3 is attached to the horizontal support as described above. A pivoting leg 51, 52 is secured to each lower end of the U-shaped mounting via a housing 54. Each pivoting leg 51 and 52 is preferably a bar, with pins welded at each end of the bar. The pins are preferably positioned perpendicularly to the bar and are directed opposite to each other. One pin is used for attaching the leg to the housing 54, and the other is to provide support on the floor. Cross bar 50 can be added to join vertical bars of the mounting if its frame needs strength re-enforcement.

As shown in FIG. 8B, a compression spring 56 is preferably tension-secured between the lower end of the U-shaped mounting and the corresponding support leg 51, 52 using pins 53 and 55 for attachment. Rotating the support leg around the pivoting point 54 will form a straight line between points 55, 54 and 53. Spring 56 will automatically and forcibly pull support leg 51 or 52 in one of the center line direction, when straight line is crossed. Angular leg position can be regulated by any types of positioning elements A or B attached to the mounting. Forcible support leg positioning is important for securing vertical frame position.

Figure 9:
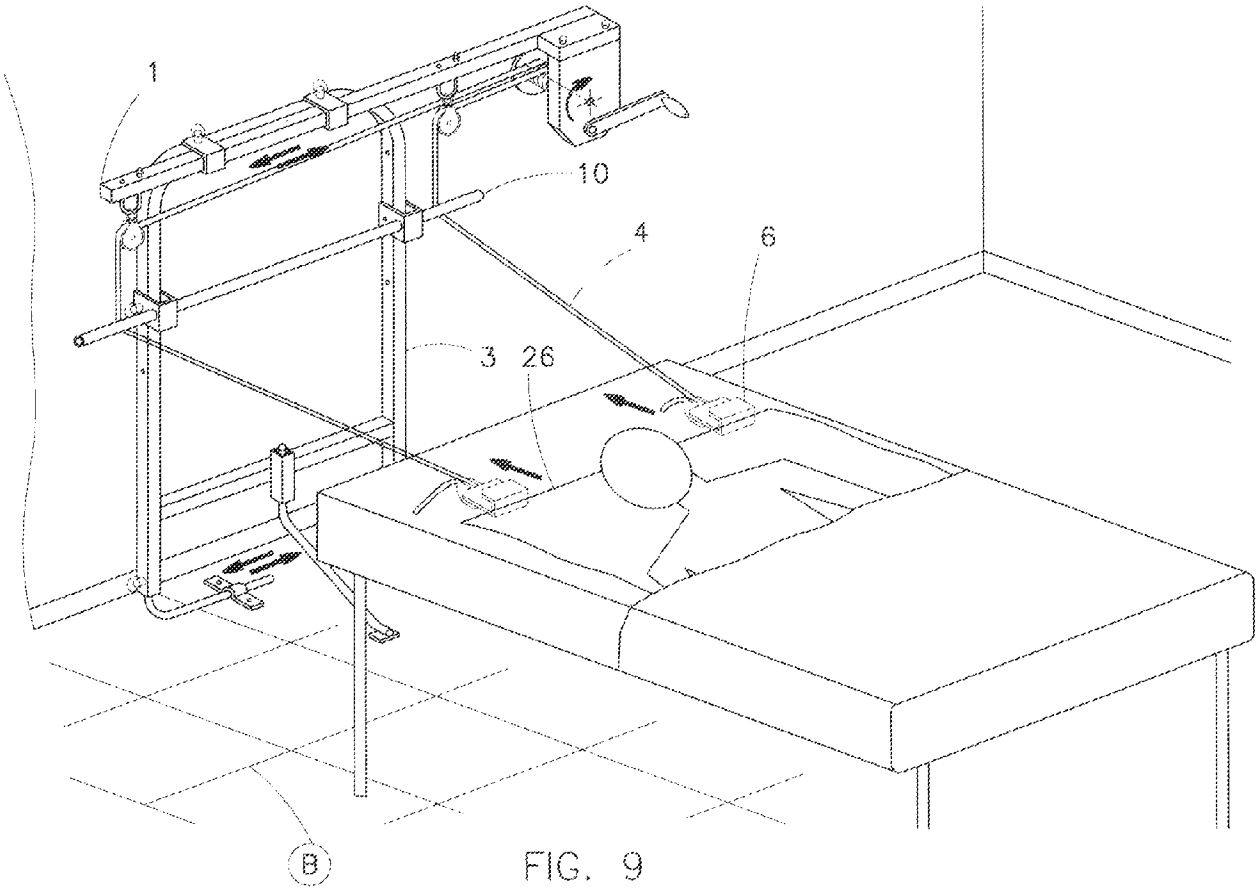
FIG. 9 is a schematic diagram illustrating operation of the patient transfer system mounted on a horizontal surface.

FIG. 9 illustrates the patient repositioning system where the system is attached to the horizontal support surface B and is distanced from the patient's bed. The retaining element 1 with the attached pulling mechanism, as described above, is secured to the U-shaped mounting 3 in a manner described above with respect to FIG. 8. Pulling cables 4, guided by pulleys 2 and guiding shaft 10, are secured to the patient support 26 via grippers 6. By activating drive 5, moving pulling cables 4 will pull the patient towards the headboard of the bed. Changing the position of the guiding pulleys and the height of the guiding shaft 10, allows the engagement grippers and, correspondingly, the patient support to move the patient in a desired direction. Described examples of the preferred construction of the patient repositioning system are only some of many design variations of system components and combinations of layouts with varieties of manual and power drives.

Figure 10:
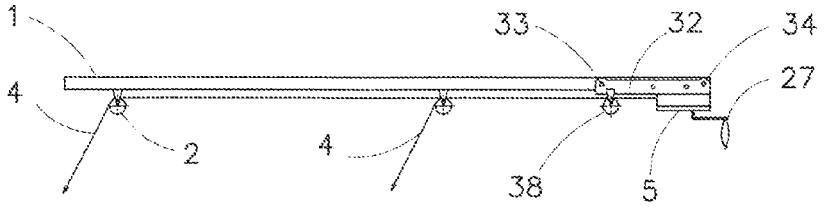
FIG. 10 is a schematic diagram illustrating a first drive position.
Figure 11:
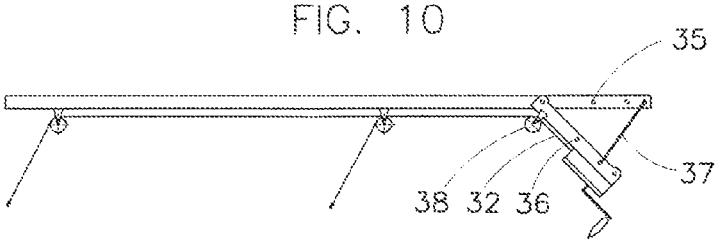
FIG. 11 is a schematic diagram illustrating a second drive position.

FIGS. 10-11 illustrate the mechanism of adjusting the position of the drive 5 relative to the retaining element or the support surface. Bracket 32 is preferably pivotally attached to the retaining element 1 at position 33 and is prevented from rotation with a removable pin 32. Retaining element 1 and bracket 32 have a set of holes 35 and 36 for inserting a distant bar 37. Drive 5 and a guiding element 38 are attached to the bracket 32. By rotating the bracket 32 around the pivoting point 31 and positioning the distant bar into holes 35 and 36, drive 5 can be positioned and secured at multiple desirable angles comfortable for operation. Guiding element 38 supports pulling cables 4.

Figure 12:
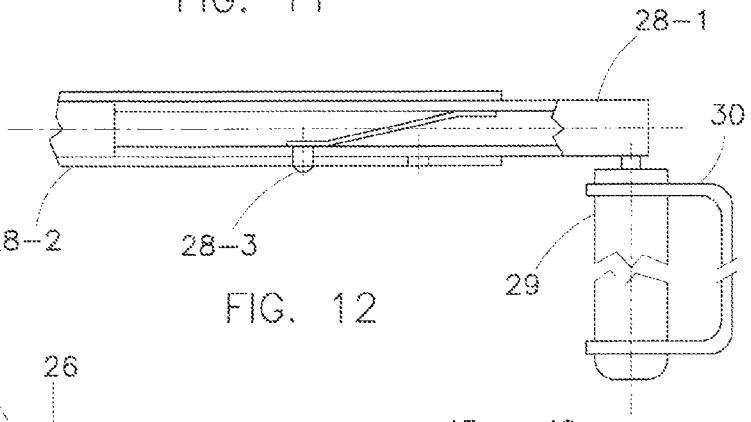
FIG. 12 is a schematic diagram illustrating a length adjustable safely operating handle of the manual drive.

FIG. 12 illustrates operation of the length adjustable revolving crank 27 for manual drive 5. Revolving crank 27 preferably includes a telescope arm 28, positioned perpendicularly to the arm revolving handle 29 and a retainer 30, attached to the handle. Telescopic arm 28 has two telescopic tubes 28-1 and 28-2, the selected length of the arm being secured with a spring loaded pin 28-3. Ability to change the length of the handle is convenient for adjusting the force applied to the manual drive to move patients of different weight. Retainer 30 is attached to the handle 29 providing enough space for comfortable positioning of the operator's hand between the handle 29 and the retainer 30. Retainer 30 can be a strip made from an elastic or other user friendly material, and can have different shape and be length adjustable to have a close and comfortable fit between the handle and the retainer. In some embodiments, the retainer 30 can be in a form of a loop, and be connected to the revolving handle 29 by a string. Size of the loop should be big enough to fit operator's hand.

In the process of patient repositioning, pulling force on cable 4 creates a torque rotating the crank 27 in a direction opposite to the rotation to pull the patient. Releasing the handle being under tension will immediately spin crank 27 in the direction opposite to pulling and can harm caregiver. To prevent reverse crank 27 spinning during the patient repositioning, after the patient is transferred into a desired position, the operator will rotate the crank 27 in the direction opposite to pulling to release pressure on the handle 29. Only after the pressure is released operator will remove his/her hand from the handle. Even experiences operators, however, can accidentally release the handle 29 and get hurt. To eliminate this possible health hazard, the operating handle of this embodiment is constructed as a combination of the revolving handle 29 with the retaining element 30. Positioning the operator's hand between the retainer 30 and the handle 29 creates pinch surfaces between the retaining elements 30, operator's hand and the handle 29, thereby preventing the revolving handle from flying away from the operator's hand by accidentally releasing the revolving handle under tension.

In use, to safely operate the manual drive the operator will position the hand on the revolving handle under the retainer prior to operation. Operator will then rotate the handle and pull the patient into a desired position. After completing patient repositioning, the operator will rotate the handle in the opposite direction until the tension on the handle is completely released, and then remove the hand from the handle.

Figure 13:
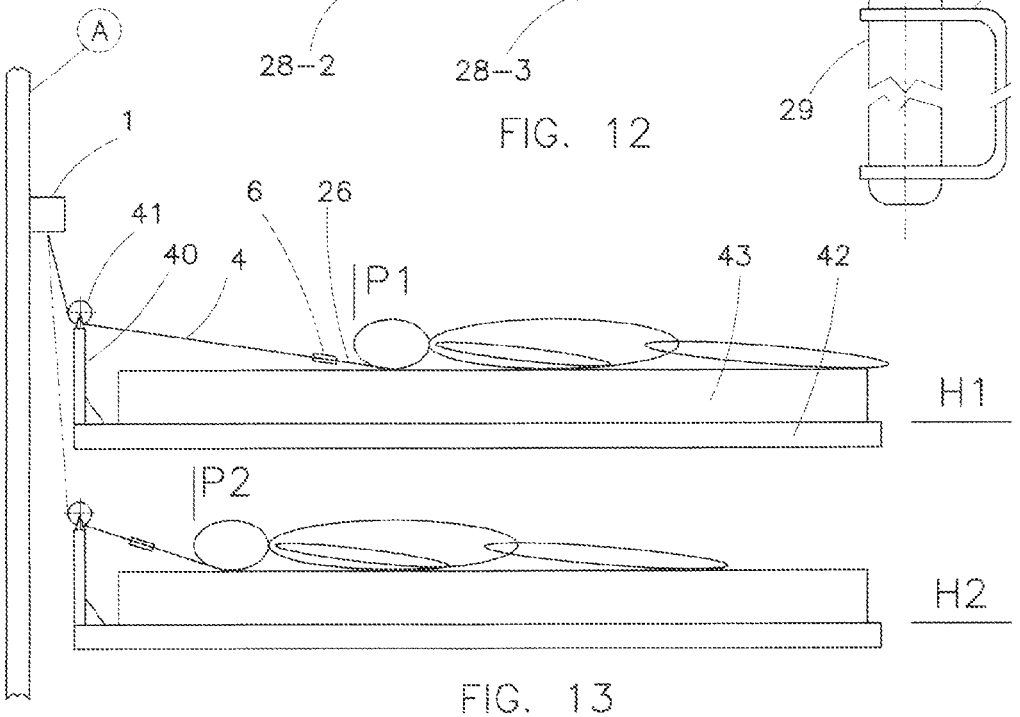
FIG. 13 is a schematic diagram of the patient transfer system used in combination with a vertically movable bed.

FIG. 13 illustrates operation of the patient repositioning system where the system is utilized in combination with a patient's bed having a vertical movement of the transfer surface 43, on which the patient is positioned. In this embodiment, the retaining element 1 of the patient repositioning system is attached to the vertical support surface A. At least one vertical bracket 40 with a guiding element 41 is attached to the frame 42 supporting the transfer surface 43 (e.g., a mattress). Guiding element 41 can be positioned at various heights on the vertical bracket 40. For patient repositioning, frame 42 is moved to the highest vertical position H1. Pulling cable 4 is placed under guiding element 41 and gripper 6 attached to the patient support 26. Cables 4 are tightened to maximize use of the vertical movement of the frame 42. Tightening of pulling cables can be done by activating drive 5, by engaging the drive's ratchet mechanism before activating the drive, or by simply adjusting the gripper positions on each pulling cable 4. Tightening of the pulling cable is important to maximize use of the vertical movement of the frame 42. In this operation, multi positioning of the guiding element 2 allows to move patient in needed direction without a precise bed positioning or patient positioning.

By moving the frame 42 and, correspondingly, the transfer surface 43 downwardly, the patient support 26 with the patient positioned thereon is moved from the first position P1 to the second position P2, where the location of the second position depends on the extent of the vertical movement of the bed. By moving frame 42 up or moving drive 5 in a direction opposite to pulling, tension on pulling cable 4 can be released and grippers 6 can be disconnected from the patient support 26. The angle of pulling the patient can be adjusted by positioning the guiding element on the vertical bracket attached to the bed or by adjusting the vertical position of the mattress on the bed's frame. Retaining element 1 can be fixed in position by using one of the previously described mounting methods. It should be obvious to a person skilled in the art, that it is not necessary to use the drive with the system described in FIG. 13. In this case, the drive can be removed and cables 4 can be attached directly to the retaining element 1 or the mounting 3. It would also be obvious to a person skilled in the art that more than one vertical bracket 40, guiding element 41 and pulling cable 4 can be used for patient repositioning.

The system, as described herein, is safe, simple, compact, lightweight and intuitive in operation. The system is characterized by a flexible pulling system, with the ability to easily adjust components' position, and to accomplish the mounting at a distance from the patient's bed or other patient transfer surfaces; with minimum or zero space requirement between the wall and the patient's bed.

In the preceding specification, the invention has been described with reference to specific exemplary embodiments thereof. It will however, be evident that various modifications and changes may be made thereto without departing from the broader spirit and scope of the invention as set forth in the claims that follow. The specification and drawings are accordingly to be regarded in an illustrative manner rather than a restrictive sense.

We claim as follows:

1. A patient lateral repositioning system, a patient being positioned on a patient support located on a patient transfer surface, and said system being supported by a structure able to withstand a pulling force to move the patient, said system comprising:

a mounting secured to a support surface, said support surface being independent from the patient transfer surface, said mounting being a frame having two vertical bars, and said mounting further comprising a removable guiding bar selectively positionable at different heights along said two vertical bars;

and a pulling system having a retaining element, a drive movably mounted on one of the retaining element and the mounting, a gripper removably attached to the patient support, at least one pulling cable flexibly connecting said drive to said gripper, and at least one guiding element supporting said at least one pulling cable, wherein said retaining element of said pulling system is movable and positionable at multiple locations along said mounting, wherein said at least one guiding element is positioned on and is movable with respect to said retaining element and is selectively positionable at plural locations along said retaining element, wherein said at least one guiding element is configured to support and guide said at least one pulling cable in a desired direction, and wherein the drive is positionable at various heights and distances away from the patient support so as not to interfere with patient service and for comfortable operation.

2. A patient lateral repositioning system to move a patient positioned on a patient support of a bed, said system being removably attached to a support surface able to withstand a pulling force to move the patient, and said system and said support surface being positioned apart from said bed, said system comprising:

a mounting as a constructive element removably attached and selectively positioned directly on the support surface and able to withstand said pulling force to move said patient positioned on said patient support of any type of a bed positioned apart and independent from the patient lateral repositioning system and said support surface; and a pulling system as a set of components including at least one retainer, a guiding element, a drive, a gripper and at least one flexible pulling cable supported by said guiding element and connecting said drive with said gripper, wherein all elements of said patient lateral repositioning system except for said gripper are not attached to said bed and said patient support, wherein said components of the pulling system are adapted for independent, adjustable and plural positioning on said mounting, wherein said independent, adjustable and plural positioning of said drive and said at least one guiding element on said mounting and a connection of said drive to said gripper with said flexible pulling cable supported by said at least one guiding element guiding element creates a flexible pulling system adapted to adjust a gripper position for proper engagement with the patient support to move the patient in a needed direction on any type of the bed positioned apart at an approximate position to said patient lateral repositioning system, wherein said guiding element is positionable at multiple vertical levels relative to the retainer, wherein said mounting is a compact constructive structure configured to fit existing patient rooms, and wherein a configuration of said mounting and components of said pulling system can be added or removed for the best system operation.

3. The system in accordance with claim 2, wherein said retainer comprises a first retaining component and a second retaining component the second retaining component being distanced from the first retaining component, wherein said first retaining component is adapted for multi-positioning of said at least one guiding element, and wherein said second retaining component is adapted for supporting said drive.

4. The system in accordance with claim 3, wherein said mounting is secured to a vertical support having a vertically positioned first bar adapted to support and adjust said first retaining component in a vertical position and a second bar adapted to support and adjust a position of the second retaining component with the drive.

5. The system in accordance with claim 2, wherein said retainer of the pulling system is attached directly to a vertical support surface.

6. The system in accordance with claim 2, wherein said mounting is a horizontally positioned single bar attached to a vertical support surface and adapted to support and adjust said pulling system in a horizontal direction.

7. The system in accordance with claim 2, wherein said mounting is secured to a vertical support surface and wherein said mounting is a frame having at least two vertically positioned bars operable to support and adjust said pulling system in horizontal and vertical directions.

8. The system in accordance with claim 2, wherein said mounting is secured to a horizontal support structure comprising a frame pivotally and removably connected to the horizontal support structure, the frame having at least two vertical bars, operatively supported in a vertical position by at least one pivotal support with one end attached to the frame and a second end resting on the support surface.

9. The system in accordance with claim 8, wherein said pivotal support comprises at least one pivotal leg having two ends and a spring, wherein one end of said leg is pivotally connected to said frame and the other of said two ends rests on the support surface, and wherein ends of said spring are positioned away from a leg pivoting point and are attached to said frame and to said leg.

10. The system in accordance with claim 9, wherein said pivotal leg is selectively forcibly positioned into a fold or an unfold position by said spring, when a point of spring connection to the arm passes a center line between points of spring connections and the leg pivoting point.

11. The system in accordance with claim 2, wherein said mounting is a frame having two vertical bars, and wherein said mounting further comprises a removable guiding bar selectively positionable at different heights along said two vertical bars.

12. The system in accordance with claim 2, wherein a position of the drive is angularly adjustable with respect to a vertical support surface.

13. The system in accordance with claim 2, wherein said drive is a manual drive having a revolving crank, operatively connected to said at least one pulling cable, where said crank comprising a length adjustable arm and a revolving handle perpendicularly positioned to the arm.

14. The system in accordance with claim 13, wherein said handle further comprises an attached retainer having a length corresponding to a size of an operator's hand, so as to create pinch surfaces between said revolving handle, said attached retainer and the operator's hand preventing handle from moving away from the operator's hand during an accidental release of the revolving handle under tension.

15. The system in accordance with claim 2 further comprising more than one of said guiding elements supporting said pulling cable.

16. The system in accordance with claim 2, wherein said at least one guiding element is connected to the patient support.

* * * * *

UNITED STATES PATENT AND TRADEMARK OFFICE

CERTIFICATE OF CORRECTION

PATENT NO. : 9,192,535 B2
APPLICATION NO. : 14/291170
DATED : November 24, 2015
INVENTOR(S) : David Sverdlik et al.

It is certified that error appears in the above-identified patent and that said Letters Patent is hereby corrected as shown below:

In the claims;

Column 10 Claim 2;

Line 61, replace "gripping element gripping element" with --gripping element--

Signed and Sealed this
Twenty-second Day of March, 2016

Michelle K. Lee

Michelle K. Lee
*Director of the United States Patent and Trademark Office*